US008552366B2

(12) United States Patent
Hoyes

(10) Patent No.: US 8,552,366 B2
(45) Date of Patent: Oct. 8, 2013

(54) MASS SPECTROMETER

(75) Inventor: John Brian Hoyes, Cheshire (GB)

(73) Assignee: Micromass UK Limited, Manchester (GB)

( * ) Notice: Subject to any disclaimer, the term of this patent is extended or adjusted under 35 U.S.C. 154(b) by 418 days.

(21) Appl. No.: 12/528,454

(22) PCT Filed: Feb. 26, 2008

(86) PCT No.: PCT/GB2008/000660
§ 371 (c)(1),
(2), (4) Date: Oct. 12, 2010

(87) PCT Pub. No.: WO2008/104771
PCT Pub. Date: Sep. 4, 2008

(65) Prior Publication Data

US 2011/0168882 A1 Jul. 14, 2011

Related U.S. Application Data

(60) Provisional application No. 60/895,560, filed on Mar. 19, 2007, provisional application No. 60/941,799, filed on Jun. 4, 2007.

(30) Foreign Application Priority Data

Feb. 26, 2007 (GB) ..... 0703682.5
May 18, 2007 (GB) ..... 0709573.0

(51) Int. Cl.
*H01J 49/06* (2006.01)
*H01J 49/40* (2006.01)
*H01J 49/42* (2006.01)

(52) U.S. Cl.
CPC ..... *H01J 49/062* (2013.01); *H01J 49/42* (2013.01); *H01J 49/408* (2013.01)
USPC ..... 250/287; 250/292

(58) Field of Classification Search
USPC ..... 250/287, 292, 281, 282
See application file for complete search history.

(56) References Cited

U.S. PATENT DOCUMENTS 3,377,563 A 4/1968 Gratreau
3,473,020 A * 10/1969 Brubaker ..... 250/290

(Continued)

FOREIGN PATENT DOCUMENTS

GB 2392775 10/2004
GB 2373630 6/2005

(Continued)

OTHER PUBLICATIONS

Combined Search and Examination Report for Application No. GB0803476.1, dated Jul. 3, 2008.

(Continued)

*Primary Examiner* — Jack Berman
(74) *Attorney, Agent, or Firm* — Diederiks & Whitelaw, PLC

(57) ABSTRACT

A mass spectrometer is disclosed comprising an ion guide or ion mobility spectrometer having helical, toroidal, part-toroidal, hemitoroidal, semitoroidal or spiral ion guiding region. The ion guide may comprise a tube made from a leaky dielectric wherein an RF voltage is applied to outer electrodes in order to confine ions radially within the ion guide. A DC voltage is applied to a resistive inner layer in order to urge ions along the ion guide. Alternatively, the ion guide may comprise a plurality of electrodes each having an aperture through which ions are transmitted.

20 Claims, 11 Drawing Sheets

(56) References Cited

U.S. PATENT DOCUMENTS

| | | | | |
|---|---|---|---|---|
| 3,867,632 | A | 2/1975 | Fite | |
| 4,126,781 | A * | 11/1978 | Siegel | 250/281 |
| 5,811,820 | A | 9/1998 | Kirchner et al. | |
| 5,825,026 | A | 10/1998 | Baykut | |
| 6,051,832 | A * | 4/2000 | Bradshaw | 250/286 |
| 6,576,897 | B1 | 6/2003 | Steiner et al. | |
| 6,713,758 | B2 | 3/2004 | Guevremont et al. | |
| 6,791,078 | B2 * | 9/2004 | Giles et al. | 250/286 |
| 6,828,553 | B2 | 12/2004 | Weiss | |
| 6,914,241 | B2 | 7/2005 | Giles et al. | |
| 7,365,317 | B2 * | 4/2008 | Whitehouse et al. | 250/292 |
| 7,829,849 | B2 | 11/2010 | Giles | |
| 8,153,960 | B2 | 4/2012 | Giles et al. | |
| 2005/0242279 | A1 | 11/2005 | Verentchikov | |

FOREIGN PATENT DOCUMENTS

| | | |
|---|---|---|
| GB | 2440970 | 2/2008 |
| WO | 02068949 | 9/2002 |
| WO | 2004023516 | 3/2004 |
| WO | 2005001878 | 1/2005 |
| WO | 2008028159 | 3/2008 |
| WO | 2008036616 | 3/2008 |

OTHER PUBLICATIONS

Wu et al. "Electrospray Ionization High-Resolution Ion Mobility Spectrometry-Mass Spectrometry", *Analytical Chemistry*. vol. 70, pp. 4929-4938, 1998.

Okumura et al., "*A Compact Sector-Type Multi-Turn Time-of-Flight Mass Spectrometer*," Nuclear Instruments & Methods in Physics Research, vol. 519, No. 1-2, pp. 331-337.

* cited by examiner

MASS SPECTROMETER

CROSS REFERENCE TO RELATED APPLICATIONS

This application is the National Stage of International Application No. PCT/GB2008/000660, filed Feb. 26, 2008, which claims priority to and benefit of United Kingdom Patent Applications Nos. 0703682.5, filed Feb. 26, 2007, and 0709573.0, filed May 18, 2007, and U.S. Provisional Patent Applications Ser. Nos. 60/895,560, filed Mar. 19, 2007, and 60/941,799, filed Jun. 4, 2007. The entire contents of these applications are incorporated herein by reference.

BACKGROUND OF THE INVENTION

The present invention relates to an ion guide, an ion mobility spectrometer or separator, a mass spectrometer, a method of guiding ions, a method of separating ions and a method of mass spectrometry. The preferred embodiment relates to a device for and method of separating ions according to differences in their ion mobility.

It is known to provide an ion guide wherein ions are confined radially by RF fields and wherein a gaseous media is provided to the ion guide. In such circumstances it is known to drive ions forwards along and through the ion guide. For example, it is known to provide an axial field as part of a collision cell forming part of a tandem mass spectrometer wherein fast transit times are desirable e.g. when performing Multiple Reaction Monitoring ("MRM"), parent ion scanning or neutral loss experiments using a triple quadrupole mass spectrometer. Similar devices may also be used to separate ions according to their ion mobility and hybrid ion mobility-mass spectrometer instruments are used for a variety of different applications.

U.S. Pat. No. 6,914,241 (Giles) describes how ions may be separated according to their ion mobility, by progressively applying transient DC voltages along the length of an RF ion guide or ion mobility separator comprising a plurality of electrodes. The ion mobility separator may comprise an AC or RF ion guide such as a multipole rod set or a stacked ring set. The ion guide is segmented in the axial direction so that independent transient DC potentials may be applied to each segment. The transient DC potentials are superimposed on top of an AC or RF voltage (which acts to confine ions radially) and/or any constant DC offset voltage. The transient DC potentials generate a travelling wave which moves along the length of the ion guide in the axial direction and which acts to translate ions along the length of the ion mobility separator.

Another known ion mobility separation device comprises a drift tube comprising a series of rings wherein a constant potential difference is maintained between adjacent members such that a constant electric field is produced. A pulse of ions is introduced into the drift tube which contains a buffer gas and ions separate along the longitudinal axis according to their ion mobility. The device is operable at atmospheric pressure without RF confinement and can offer a resolution of up to 150 (Wu et, al. Anal. Chem, 1998, 70 4929-4938). Operation at lower pressures more suitable for hybrid ion mobility-mass spectrometer instruments leads to greater diffusion losses and lower resolution.

An RF pseudo-potential well may be arranged to confine ions radially and may be used to transportions efficiently by acting as an ion guide thereby solving the problem of diffusion losses. Ions may be propelled along the guide and ions may be separated according to their ion mobility. However, in order to achieve a high resolution of mobility separation at relatively low pressures, a relatively long drift tube must be employed in order to keep within the low field limit as described in more detail below.

In order to separate ions according to their mobility in an RF ion guide, an axial DC electric field may be generated which is orthogonal to the RF radial confinement. If a constant axial electric field E is applied in order to drive ions along and through an ion guide containing a gas, then the ion will acquire a characteristic velocity:

$$v_d = E \cdot K \tag{1}$$

wherein K is the ion mobility.

To achieve a mobility separation whereby ions acquire negligible energy compared to the background thermal energy of a gas, it is necessary to consider the parameter E/P, wherein P is the pressure of the neutral gas.

To maintain ion mobility separation in the so called low field regime whereby ions do not receive kinetic energy from the driving field it is necessary that the parameter E/P is maintained at a value less than about 2V/cm-mbar.

Under low field conditions in a drift tube having a length L and wherein a voltage drop V is applied the resolution is found to be independent of ion mobility and only dependent upon the voltage drop such that in the absence of space charge effects:

$$\frac{L}{|\bar{x}|} = \frac{\sqrt{V}}{0.173} \tag{2}$$

wherein $|\bar{x}|$ is the mean displacement of the centre of mass of the moving ion cloud.

The parameter $L/|\bar{x}|$ is effectively the resolution of the mobility separation. It will therefore be apparent that the performance of the ion mobility spectrometer can be increased by applying voltage drops across the length of the drift tube.

In a hybrid ion mobility-mass spectrometer the typical pressure of the ion mobility drift region is in the region 0.5-1 mbar. Operating at pressures much greater than this puts great demands upon the vacuum system which needs to be differentially pumped in order for the mass spectrometer stages to operate efficiently.

At a typical drift tube length of 20 cm and an operating pressure of 0.5 mbar the maximum voltage that can be applied within the low field limit is 20 V. This results in a maximum resolution. of 26. In order to achieve a resolution of 100 under the same conditions would require a drift tube length having a length more than 3 meters long. However, this is impractical for commercial mass spectrometers.

It is therefore desired to provide an improved ion guide and ion mobility spectrometer or separator.

SUMMARY OF THE INVENTION

According to an aspect of the present invention there is provided an ion guide comprising one or more helical, toroidal, part-toroidal, hemitoroidal, semitoroidal or spiral tubes through which ions are transmitted in use.

Ions are preferably arranged to travel in substantially helical, toroidal, part-toroidal, hemitoroidal, semitoroidal or spiral orbits as they pass along and through the ion guide.

The one or more tubes are preferably formed from a leaky dielectric. For example, the one or more tubes may be formed from resistive glass such as lead silicate doped glass. The tube preferably has a resistance in the range $10^6$-$10^{11}\Omega$ and may be provided with nichrome, copper or gold electrodes. According to an embodiment the leaky dielectric tube may have a dielectric constant in the range 1-50, preferably 5-20 and a magnetic permeability preferably in the range 1-1000, preferably 100-500. The leaky dielectric tube preferably has a resistivity $>10^5$ Ω-cm, further preferably $10^6$-$10^{11}$ Ω-cm. According to another embodiment the tube may comprise a ceramic tube such as, for example, a carbon-nickel-zinc ceramic tube.

The internal diameter of the one or more tubes is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm. The external diameter of the one or more tubes is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm. The wall thickness of the one or more tubes is preferably selected from the group consisting of: (i) <1 mm; (ii) 1-2 mm; (iii) 2-3 mm; (iv) 3-4 mm; (v) 4-5 mm; (vi) 5-6 mm; (vii) 6-7 mm; (viii) 7-8 mm; (ix) 8-9 mm; (x) 9-10 mm; and (xi) >10 mm.

The length of the one or more tubes measured along the helical, toroidal, part-toroidal, hemitoroidal, semitoroidal or spiral path of the ion guide is preferably selected from the group consisting of: (i) <10 cm; (ii) 10-20 cm; (iii) 20-30 cm; (iv) 30-40 cm; (v) 40-50 cm; (vi) 50-60 cm; (vii) 60-70 cm; (viii) 70-80 cm; (ix) 80-90 cm; (x) 90-100 cm; (xi) 100-110 cm; (xii) 110-120 cm; (xiii) 120-130 cm; (xiv) 130-140 cm; (xv) 140-150 cm; (xvi) 150-160 cm; (xvii) 160-170 cm; (xviii) 170-180 cm; (xix) 180-190 cm; (xx) 190-200 cm; (xxi) 200-210 cm; (xxii) 210-220 cm; (xxiii) 220-230 cm; (xxiv) 230-240 cm; (xxv) 240-250 cm; (xxvi) 250-260 cm; (xxvii) 260-270 cm; (xxviii) 270-280 cm; (xxix) 280-290 cm; (xxx) 290-300 cm; (xxxi) 300-310 cm; (xxxii) 310-320 cm; (xxxiii) 320-330 cm; (xxxiv) 330-340 cm; (xxxv) 340-350 cm; (xxxvi) 350-360 cm; (xxxvii) 360-370 cm; (xxxviii) 370-380 cm; (xxxix) 380-390 cm; (xl) 390-400 cm; (xli) 400-410 cm; (xlii) 410-420 cm; (xliii) 420-430 cm; (xliv) 430-440 cm; (xlv) 440-450 cm; (xlvi) 450-460 cm; (xlvii) 460-470 cm; (xlviii) 470-480 cm; (xlix) 480-490 cm; (1) 490-500 cm; and (li) >500 cm.

The ion guide preferably further comprises either:

(a) one or more AC or RF electrodes arranged on or in an outer surface of the one or more tubes; and/or (b) one or more AC or RF electrodes arranged on or in an inner surface of the one or more tubes.

According to an embodiment the ion guide further comprises a device arranged and adapted to supply an AC or RF voltage to the one or more AC or RF electrodes, wherein either:

(a) the AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and/or (b) the AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment the ion guide further comprises either:

(a) one or more resistive, semiconductive or conductive surfaces or coatings arranged on or in an inner surface of the one or more tubes; and/or (b) one or more resistive, semiconductive or conductive surfaces or coatings arranged on or in an outer surface of the one or more tubes.

According to an embodiment the ion guide may further comprise a device arranged and adapted to supply one or more DC voltages to the one or more resistive, semiconductive or conductive surfaces or coatings in order to urge, force, drive or propel ions through the ion guide.

According to an embodiment the ion guide may comprise a device arranged and adapted to maintain a DC voltage or potential gradient along at least 5%, 10%, 15%, 20%, 25%, 30%, 35%, 40%, 45%, 50%, 55%, 60%, 65%, 70%, 75%, 80%, 85%, 90%, 95% or 100% of the length of the ion guide in order to urge, force, drive or propel ions through the ion guide.

According to an embodiment the ion guide may comprise an ion entrance port and an ion exit port and wherein, in use, a non-zero DC voltage or potential gradient is maintained between the ion entrance port or an entrance region of the ion guide and the ion exit port or an exit region of the ion guide, wherein the non-zero DC voltage or potential gradient is arranged to urge, force, drive or propel ions through the ion guide from the ion entrance port to the ion exit port.

According to another aspect of the present invention there is provided an ion guide comprising a plurality of electrodes each having one or more apertures through which ions are transmitted in use, wherein the ion guide comprises a helical, toroidal, part-toroidal, hemitoroidal, semitoroidal or spiral ion guiding region.

The length of the ion guiding region measured along the helical, toroidal, part-toroidal, hemitoroidal, semitoroidal or spiral path of the ion guide is preferably selected from the group consisting of: (i) <10 cm; (ii) 10-20 cm; (iii) 20-30 cm; (iv) 30-40 cm; (v) 40-50 cm; (vi) 50-60 cm; (vii) 60-70 cm; (viii) 70-80 cm; (ix) 80-90 cm; (x) 90-100 cm; (xi) 100-110 cm; (xii) 110-120 cm; (xiii) 120-130 cm; (xiv) 130-140 cm; (xv) 140-150 cm; (xvi) 150-160 cm; (xvii) 160-170 cm; (xviii) 170-180 cm; (xix) 180-190 cm; (xx) 190-200 cm; (xxi) 200-210 cm; (xxii) 210-220 cm; (xxiii) 220-230 cm; (xxiv) 230-240 cm; (xxv) 240-250 cm; (xxvi) 250-260 cm; (xxvii) 260-270 cm; (xxviii) 270-280 cm; (xxix) 280-290 cm; (xxx) 290-300 cm; (xxxi) 300-310 cm; (xxxii) 310-320 cm; (xxxiii) 320-330 cm; (xxxiv) 330-340 cm; (xxxv) 340-350 cm; (xxxvi) 350-360 cm; (xxxvii) 360-370 cm; (xxxviii) 370-380 cm; (xxxix) 380-390 cm; (xl) 390-400 cm; (xli) 400-410 cm; (xlii) 410-420 cm; (xliii) 420-430 cm; (xliv) 430-440 cm; (xlv) 440-450 cm; (xlvi) 450-460 cm; (xlvii) 460-470 cm; (xlviii) 470-480 cm; (xlix) 480-490 cm; (1) 490-500 cm; and (li) >500 cm.

According to an embodiment the ion guide further comprises a device arranged and adapted to supply an AC or RF voltage to the plurality of electrodes, wherein either:

(a) the AC or RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and/or (b) the AC or RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

According to an embodiment the ion guide further comprises a device arranged and adapted to supply one or more DC voltages to the plurality of electrodes in order to urge, force, drive or propel ions through the ion guide.

The ion guide preferably comprises a device arranged and adapted to maintain a DC voltage or potential gradient along at least 5%, 10%, 15%, 20%, 25%, 30%, 35%, 40%, 45%, 50%, 55%, 60%, 65%, 70%, 75%, 80%, 85%, 90%, 95% or 100% of the length of the ion guide in order to urge, force, drive or propel ions through the ion guide.

The ion guide preferably comprises an ion entrance port and an ion exit port and wherein, in use, a non-zero DC voltage or potential gradient is maintained between the ion entrance port or an entrance region of the ion guide and the ion exit port or an exit region of the ion guide, wherein the non-zero DC voltage or potential gradient is arranged to urge, force, drive or propel ions through the ion guide from the ion entrance port to the ion exit port.

The ion guide comprising a plurality of electrodes having apertures preferably further comprises transient DC voltage means arranged and adapted to apply one or more transient DC voltages or potentials or one or more transient DC voltage or potential waveforms to at least some of the plurality of electrodes in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of the ion guide. However, according to a less preferred embodiment the tubular ion guide disclosed above may be provided with a plurality of electrodes along the ion guiding path of the ion guide, and one or more transient DC voltages or potentials or one or more transient DC voltage or potential waveforms may be applied to at least some of the plurality of electrodes in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of the tubular ion guide.

According to an embodiment the ion guide further comprises means arranged and adapted to vary, increase or decrease the amplitude of the one or more transient DC voltages or potentials or the one or more transient DC voltage or potential waveforms with time or wherein the amplitude of the one or more transient DC voltages or potentials or the one or more transient DC voltage or potential waveforms is ramped, stepped, scanned or varied linearly or non-linearly with time.

In a mode of operation the one or more transient DC voltages or potentials or the one or more transient DC voltage or potential waveforms are preferably translated along the length of the ion guide at a velocity selected from the group consisting of: (i) <100 m/s; (ii) 100-200 m/s; (iii) 200-300 m/s; (iv) 300-400 m/s; (v) 400-500 m/s; (vi) 500-600 m/s; (vii) 600-700 m/s; (viii) 700-800 m/s; (ix) 800-900 m/s; (x) 900-1000 m/s; (xi) 1000-1100 m/s; (xii) 1100-1200 m/s; (xiii) 1200-1300 m/s; (xiv) 1300-1400 m/s; (xv) 1400-1500 m/s; (xvi) 1500-1600 m/s; (xvii) 1600-1700 m/s; (xviii) 1700-1800 m/s; (xix) 1800-1900 m/s; (xx) 1900-2000 m/s; (xxi) 2000-2100 m/s; (xxii) 2100-2200 m/s; (xxiii) 2200-2300 m/s; (xxiv) 2300-2400 m/s; (xxv) 2400-2500 m/s; (xxvi) 2500-2600 m/s; (xxvii) 2600-2700 m/s; (xxviii) 2700-2800 m/s; (xxix) 2800-2900 m/s; (xxx) 2900-3000 m/s; and (xxxi) >3000 m/s. According to an embodiment the velocity at which the one or more transient DC voltage or potential waveforms are preferably translated along the length of the ion guide may be varied, increased or decreased.

The ion guide preferably further comprises one or more first substrates provided on a first side of the plurality of electrodes and/or one or more second substrates provided on a second side of the plurality of electrodes. The one or more first substrates and/or the one or more second substrates are preferably formed from a material selected from the group consisting of: (i) a circuit board; (ii) a printed circuit board; (iii) a non-conductive substrate; (iv) phenolic paper; (v) glass fibre; (vi) plastic; (vii) polyimide; (viii) Teflon; (ix) ceramic; (x) laminate; (xi) FR-2; (xii) FR-4; (xiii) GETEK; (xiv) BT-Epoxy; (xv) cyanate ester; (xvi) pyralux; and (xvii) Polytetrafluoroethylene ("PTFE").

According to an embodiment an entrance region and/or a central region and/or an exit region of the ion guide is preferably maintained in use at a pressure selected from the group consisting of: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-5}$ mbar; (ix) $>10^{-6}$ mbar; (x) <100 mbar; (xi) <10 mbar; (xii) <1 mbar; (xiii) <0.1 mbar; (xiv) $<10^{-2}$ mbar; (xv) $<10^{-2}$ mbar; (xvi) $<10^{-4}$ mbar; (xvii) $<10^{-5}$ mbar; (xviii) $<10^{-6}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to $10^{-2}$ mbar; (xxiv) $10^{-4}$ to $10^{-3}$ mbar; and (xxv) $10^{-5}$ to $10^{-4}$ mbar.

According to an embodiment the ion guide may be supplied with a gas selected from the group consisting of: (i) xenon; (ii) uranium hexafluoride ("$UF_8$"); (iii) isobutane ("$C_4H_{10}$"); (iv) argon; (v) krypton; (vi) perfluoropropane ("$C_3F_8$"); (vii) hexafluoroethane ("$C_2F_6$"); (viii) hexane ("$C_6H_{14}$"); (ix) benzene ("$C_6H_6$"); (x) carbon tetrachloride ("$CCl_4$"); (xi) iodomethane ("$CH_3I$"); (xii) diiodomethane ("$CH_2I_2$"); (xiii) carbon dioxide ("$CO_2$"); (xiv) nitrogen dioxide ("$NO_2$"); (xv) sulphur dioxide ("$SO_2$"); (xvi) phosphorus trifluoride ("$PF_3$"); (xvii) disulphur decafluoride ("$S_2F_{10}$"); (xviii) nitrogen; (xix) air; (xx) methane; and (xxi) carbon dioxide.

In a mode of operation ions may be transmitted along and through the ion guide without substantially being separated within the ion guide according to their ion mobility or rate of change of ion mobility with electric field strength.

According to an embodiment the ion guide may further comprise AC or RF voltage means arranged and adapted to apply two or more phase-shifted AC or RF voltages to electrodes forming at least part of the ion guide in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of the ion guide.

According to an embodiment in a mode of operation ions are accelerated within the ion guide so that they substantially achieve a terminal velocity.

According to an embodiment in a mode of operation singly charged ions having a mass to charge ratio in the range of 1-100, 100-200, 200-300, 300-400, 400-500, 500-600, 600-700, 700-800, 800-900, 900-1000 or >1000 preferably have a drift or transit time through the ion guide in the range: (i) 0-1 ms; (ii) 1-2 ms; (iii) 2-3 ms; (iv) 3-4 ms; (v) 4-5 ms; (vi) 5-6 ms; (vii) 6-7 ms; (viii) 7-8 ms; (ix) 8-9 ms; (x) 9-10 ms; (xi) 10-11 ms; (xii) 11-12 ms; (xiii) 12-13 ms; (xiv) 13-14 ms; (xv) 14-15 ms; (xvi) 15-16 ms; (xvii) 16-17 ms; (xviii) 17-18 ms; (xix) 18-19 ms; (xx) 19-20 ms; (xxi) 20-21 ms; (xxii) 21-22 ms; (xxiii) 22-23 ms; (xxiv) 23-24 ms; (xxv) 24-25 ms; (xxvi) 25-26 ms; (xxvii) 26-27 ms; (xxviii) 27-28 ms; (xxix) 28-29 ms; (xxx) 29-30 ms; (xxxi) 30-35 ms; (xxxii) 35-40 ms; (xxxiii) 40-45 ms; (xxxiv) 45-50 ms; (xxxv) 50-55 ms; (xxxvi) 55-60 ms; (xxxvii) 60-65 ms; (xxxviii) 65-70 ms; (xxxix) 70-75 ms; (xl) 75-80 ms; (xli) 80-85 ms; (xlii) 85-90 ms; (xliii) 90-95 ms; (xliv) 95-100 ms; and (xlv) >100 ms.

According to an embodiment in a mode of operation ions may be collisionally cooled and/or thermalised by collisions with a gas within the ion guide.

According to another aspect of the present invention there is provided an ion mobility separator or ion mobility spectrometer comprising an ion guide as described above and wherein ions are arranged and adapted to be separated within the ion guide according to their ion mobility or their rate of change of ion mobility with electric field strength.

According to another aspect of the present invention there is provided a collision, reaction or fragmentation device comprising an ion guide as described above and wherein the ion guide forms part of a collision, reaction or fragmentation device selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions.

According to another aspect of the present invention there is provided a mass spectrometer further comprising an ion guide as described above.

According to another aspect of the present invention there is provided a mass spectrometer further comprising an ion mobility separator or an ion mobility spectrometer as described above.

According to another aspect of the present invention there is provided a mass spectrometer further comprising a collision, fragmentation or reaction device as described above.

The mass spectrometer preferably further comprises an ion source arranged upstream and/or downstream of the ion guide, the ion mobility separator or ion mobility spectrometer, or the collision, fragmentation or reaction device, wherein the ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; and (xviii) a Thermospray ion source.

An ion mobility separation device and/or a Field Asymmetric Ion Mobility Spectrometer device is preferably arranged upstream and/or downstream the ion guide, the ion mobility separator or ion mobility spectrometer, or the collision, fragmentation or reaction device.

An ion trap or ion trapping region is preferably arranged upstream and/or downstream of the ion guide, the ion mobility separator or ion mobility spectrometer, or the collision, fragmentation or reaction device.

A collision, fragmentation or reaction cell is preferably arranged upstream and/or downstream of the ion guide, the ion mobility separator or ion mobility spectrometer, or the collision, fragmentation or reaction device. The collision, fragmentation or reaction cell is selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions.

The mass spectrometer preferably comprises a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

According to another aspect of the present invention there is provided a method of guiding ions comprising:

providing an ion guide comprising a helical, toroidal, part-toroidal, hemitoroidal, semitoroidal or spiral tube; and transmitting ions through the ion guide.

According to another aspect of the present invention there is provided a method of guiding ions comprising:

providing an ion guide comprising a plurality of electrodes each having one or more apertures; and transmitting ions through the one or more apertures, wherein the ion guide comprises a helical, toroidal, part-toroidal, hemitoroidal, semitoroidal or spiral ion guiding region.

According to another aspect of the present invention there is provided a method of separating ions according to their ion mobility comprising a method as described above and wherein ions are separated according to their ion mobility or their rate of change of ion mobility with electric field strength as they are transmitted through the ion guide.

According to another aspect of the present invention there is provided a method of colliding, reacting or fragmenting ions, comprising a method as described above and wherein ions are collided, reacted or fragmented as they pass through the ion guide and wherein the ion guide forms part of a collision, reaction or fragmentation device selected from the group consisting of: (i) a Collisional Induced Dissociation ("CID") fragmentation device; (ii) a Surface Induced Dissociation ("SID") fragmentation device; (iii) an Electron Transfer Dissociation fragmentation device; (iv) an Electron Capture Dissociation fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an ion-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; and (xxviii) an ion-metastable atom reaction device for reacting ions to form adduct or product ions.

According to another aspect of the present invention there is provided a method of mass spectrometry comprising a method as described above.

According to another aspect of the present invention there is provided a glass or ceramic tubular ion guide or ion mobility separator wherein ions are arranged and adapted to travel in substantially helical, toroidal, part-toroidal, hemitoroidal, semitoroidal or spiral orbits as they pass along and through the ion guide or ion mobility separator.

According to another aspect of the present invention there is provided a method of guiding ions or separating ions according to their ion mobility, comprising passing ions along and through a glass or ceramic tubular ion guide or ion mobility separator wherein ions travel in substantially helical, toroidal, part-toroidal, hemitoroidal, semitoroidal or spiral orbits.

According to another aspect of the present invention there is provided an ion guide comprising a tubular ion guide wherein the tubular ion guide has a shape corresponding to that of a tube wound around a straight or curved inner tube.

According to another aspect of the present invention there is provided a method of guiding ions comprising:

transmitting ions through a tubular ion guide wherein the tubular ion guide has a shape corresponding to that of a tube wound around a straight or curved inner tube.

According to a preferred embodiment a compact, relatively high resolution and relatively high transmission low field ion mobility separator is preferably provided. The preferred ion mobility separator may be incorporated into a hybrid ion mobility-mass spectrometer arrangement.

According to the preferred embodiment the drift length of the preferred ion mobility spectrometer or separator is preferably increased by constraining ions into taking a helical path. The overall physical dimensions of the preferred device are preferably considerably reduced when compared to a conventional ion mobility separator comprising a longitudinal drift tube having a comparable length.

According to an embodiment the ion mobility spectrometer may comprise a hollow glass tube which preferably has a resistive inner coating which is preferably capable of supporting a DC electric field. Conductive electrodes may be deposited on the outer surface and may be supplied with an AC or RF voltage in order to confine ions radially within the device.

According to an embodiment the ion guide may comprise a resistive glass ion guide. For example, the ion guide may comprise a lead silicate doped glass which is preferably formed into one or more tubes. The tubes may be heat treated to produce a semiconductive layer on the inside surface of the glass which may be only a few hundred Angstroms thick. Such material has been used, for example, to construct a Time of Flight reflectron (ASMS 2006, MP09, 196).

According to the preferred embodiment an AC or RF voltage may be applied to four, six or eight electrodes which are preferably deposited on the outside surface of the tube. A multipole electric field is preferably formed which preferably penetrates the tube walls so that ions within the tube are preferably caused to be confined radially within the tube.

According to an embodiment the tube or ion guide may be pressurised with a gas which in addition to providing a dispersive medium acts with the AC or RF potential or voltage to collisionally focus the ions in a radial direction towards the centre of the guide.

A drift field is preferably produced by applying a DC voltage between the input and output ends of the tube. Ions are preferably caused to separate according to their ion mobility as they traverse along the path of the tube. One or more portions of the helical guide may be segmented and may act, for example, as one or more ion storage regions in order to accumulate ions for pulsed ejection subsequent stages of the mass spectrometer.

According to a less preferred embodiment the ion guide may comprise two co-axial tubes wherein ions are guided through the inner tube and/or ions are guided through the annulus between the inner and outer tubes.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
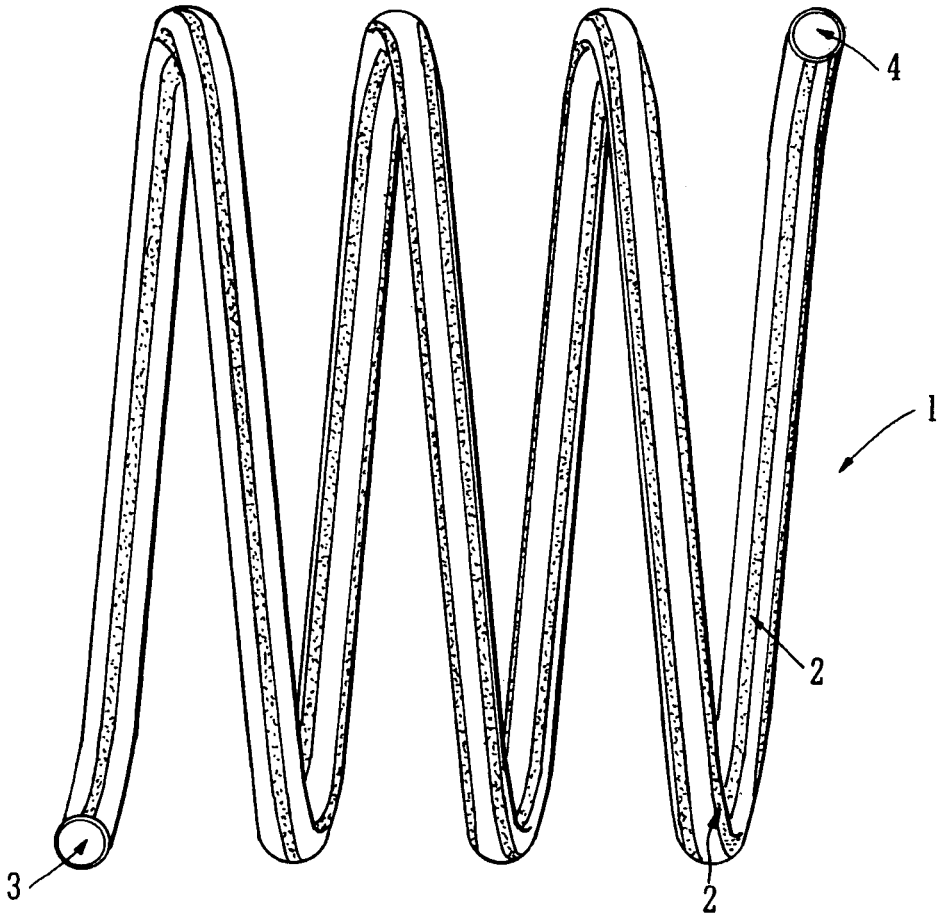
FIG. 1 shows an ion guide or ion mobility separator according to an embodiment wherein the ion guide or ion mobility separator comprises a helical glass tube wherein a plurality of RF electrodes are provided on the outer surface.

A first main embodiment of the present invention will now be described with reference to FIGS. 1-3. According to the first main embodiment a helical hollow tube 1 formed of resistive glass is preferably provided. A plurality of AC or RF electrodes 2 are preferably provided on the outer surface of the helical tube 1. Ions are preferably arranged to enter the helical tube 1 via an entrance port 3 and preferably exit the helical tube 1 via an exit port 4.

According to one embodiment the glass tube may have a resistance in the range $10^6$-$10^{11}\Omega$ and may be provided with nichrome, copper or gold electrodes. The tubes may, for example, be made from a lead silicate glass which is available from BURLE® Technologies, USA.

According to a less preferred embodiment the tube may be made from a ceramic. According to one embodiment the ceramic may comprise a carbon-nickel-zinc ceramic such as CERAMAG C/12® or CERAMAG C/9® manufactured by Stackpole Carbon Corporation, USA and as referred to in U.S. Pat. No. 3,867,632.

The tube may according to one embodiment have a dielectric constant in the range 1-50, preferably 10, a magnetic permeability in the range 1-1000 (preferably 100-800) and a resistivity preferably $>10^5$ Ω-cm.

A parameterised version of the equation for a helical surface may be given in cylindrical polar coordinates by the following equations:

$$r(t, v) = A + B\cos(t) \tag{3}$$

$$\theta(t, v) = v \tag{4}$$

$$z(t, v) = B\cos(t) + C\frac{v}{2} \tag{5}$$

wherein A is the radius from the axis around which the helix is wound to the centre of the tube, B is the radius of the tube and C determines the pitch of the windings.

For such a structure to be possible it is necessary for the following relationship to be satisfied:

$$C > \frac{B}{\pi} \tag{6}$$

If the above condition is not met then the tube surface will cut in on itself if more than one turn is generated.

Figure 2:
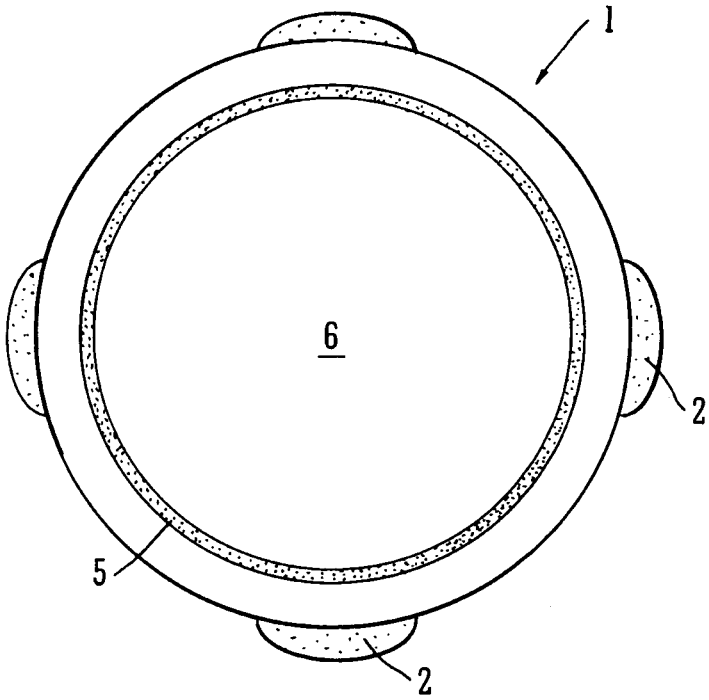
FIG. 2 shows a cross-sectional of a hollow helical glass tube according to an embodiment of the present invention.

FIG. 2 shows a cross-section of a helical tube 1 according to an embodiment of the present invention showing metallised outer electrodes 2 to which an AC or RF voltage is preferably applied and an inner resistive coating 5 to which a DC voltage is preferably applied. A gas 6 such as argon, nitrogen, xenon, air, methane or carbon dioxide is preferably present within the tube 1 in use.

Figure 3:
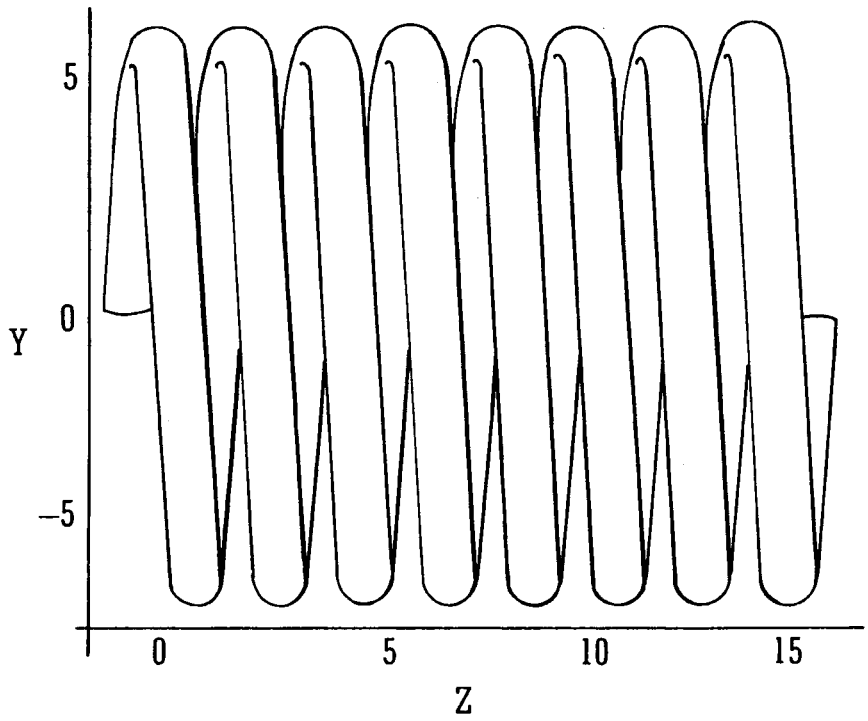
FIG. 3 shows a helical ion guide or ion mobility separator according to an embodiment of the present invention.

FIG. 3 shows a plot of an ion guide or ion mobility separator according to an embodiment of the present invention and having a helical surface with the values A=6, B=0.6 and C=0.3 for $t=0\rightarrow 2\pi$ and $v=0\rightarrow 16\pi$.

The inner surface of the tube 1 is preferably coated with a resistive layer 5 at some smaller value of the radius B. Ions are therefore preferably confined to an inner volume. The nature of the curved geometry of the device preferably means that electric fields are asymmetrical in the body of the device as distinct from a conventional multipole geometry wherein electric fields are symmetric about the longitudinal optic axis.

According to one particular example A=60 mm, B=6 mm and the wall thickness may be 0.5 mm. The angle θ determines the number of turns. According to an embodiment θ may be 16π (i.e. 8 turns) thereby giving a length of 3 m. Operating the tube at a voltage of 300 V and at a pressure of 0.5 mbar will result in an ion mobility separator device having a resolution of approximately 100.

Figure 4:
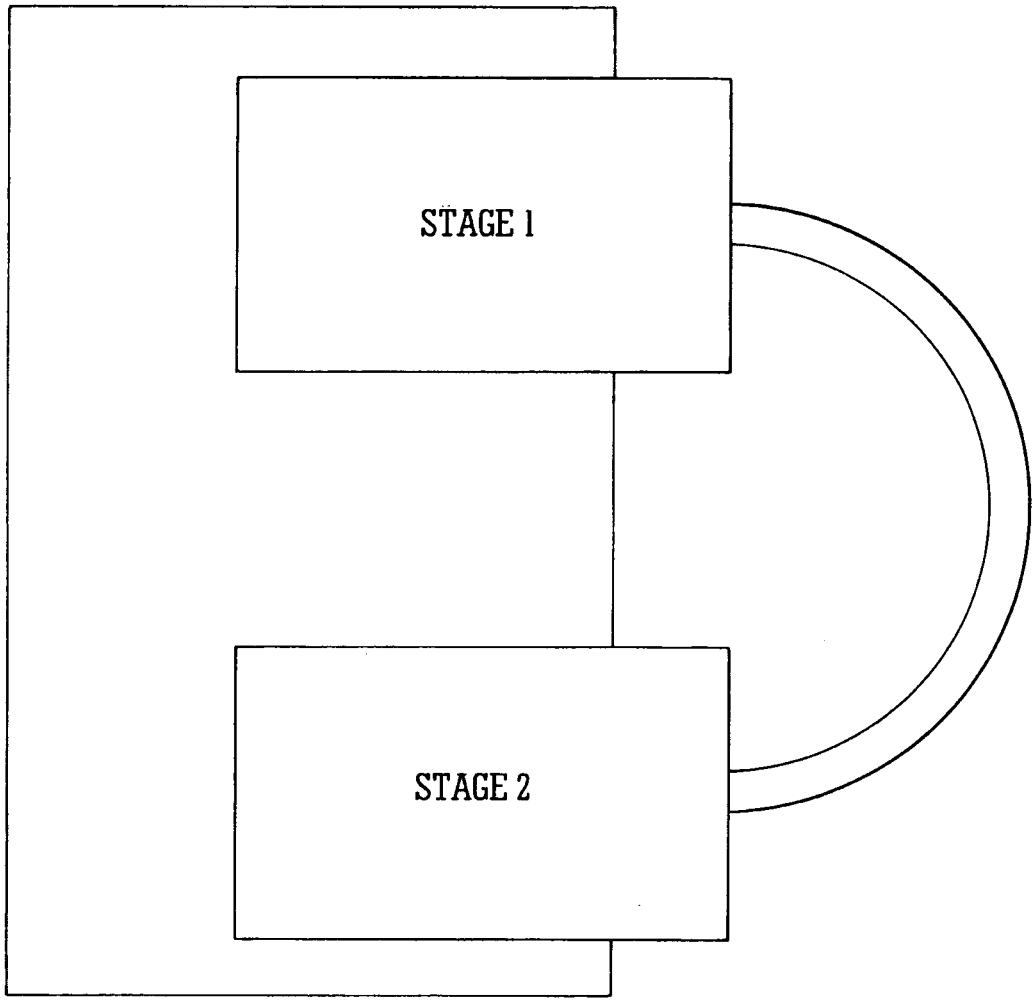
FIG. 4 shows a hemitoroidal ion guide or ion mobility separator which is arranged to couple two stages of a mass spectrometer.
Figure 5:
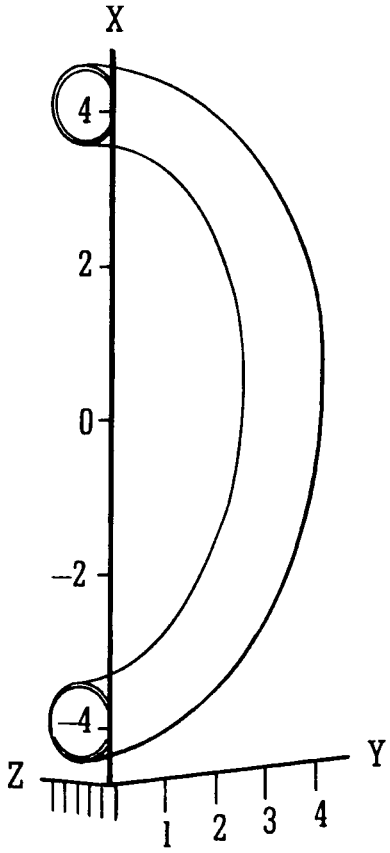
FIG. 5 shows a hemitoroidal ion guide or ion mobility separator according to an embodiment of the present invention.

According to another embodiment the device may comprise a hemitoroidal arrangement as shown, for example, in FIGS. 4 and 5. The ion guide or ion mobility separator may be used to couple two stages or components of a mass spectrometer as shown in FIG. 4.

The particular hemitoroidal ion guide shown in FIG. 5 has the parameters A=4, B=0.5 and C=0. If C is set to zero in the above equations then the described surface will become toroidal in nature and hence according to other embodiments the ion guide or ion mobility separator may have a toroidal or part-toroidal shape. Such a device is useful in reducing the size of a hybrid mass spectrometer by enabling a folded geometry configuration to be utilised while confining ions efficiently.

Figure 6:
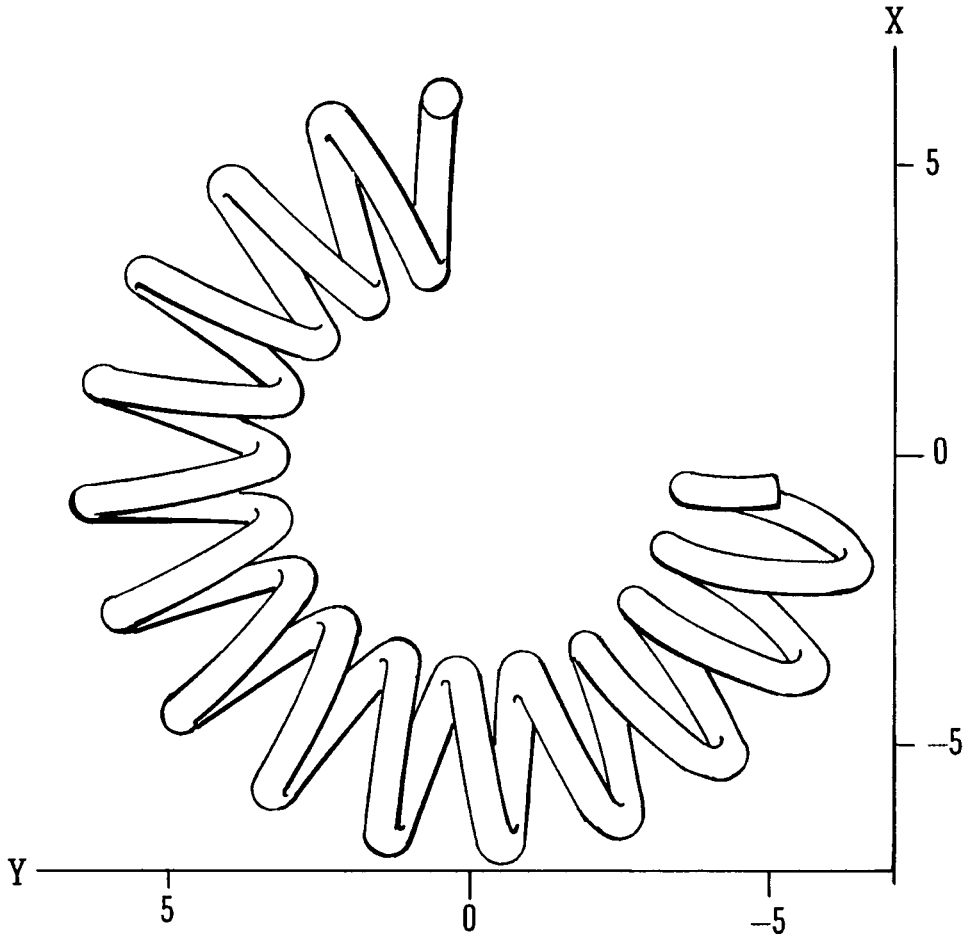
FIG. 6 shows a 270° section of a tube wrapped around a torus according to an embodiment of the present invention.

According to another embodiment an ion guide or ion mobility separator may be provided wherein the shape of the ion guide is like a tube wrapped around a torus or an imaginary circular tube which is curved to form a circle as shown in FIG. 6. The ion guide or ion mobility separator according to this embodiment may appear similar in form to the windings of a toroidal transformer. FIG. 6 shows a 270° section of such an embodiment but it will be understood that any desired section may be chosen.

According to other embodiments the ion guide, the ion mobility spectrometer or the resistive glass tube may have a non-circular cross-section such as for example an oval, square, rectangular or polygonal cross-section.

According to another embodiment higher order multipoles may be used to confine the ions within the tubular ion guide or ion mobility separator. A higher order multipole offers greater mass to charge ratio transmission bandwidth associated with the conventional longitudinal devices. Similarly two interwound wires may be wrapped around the tube, each wire carrying opposite phases of an AC or RF voltage in order to confine-ions radially within the ion guide or ion mobility separator.

The preferred device of the present invention is preferably intended to operate in various different modes of operation. The device may, for example, be operated in conjunction with an upstream ion trap to allow ions to accumulate whilst ion mobility separation is taking place to enable 100% duty cycle operation.

Figure 7:
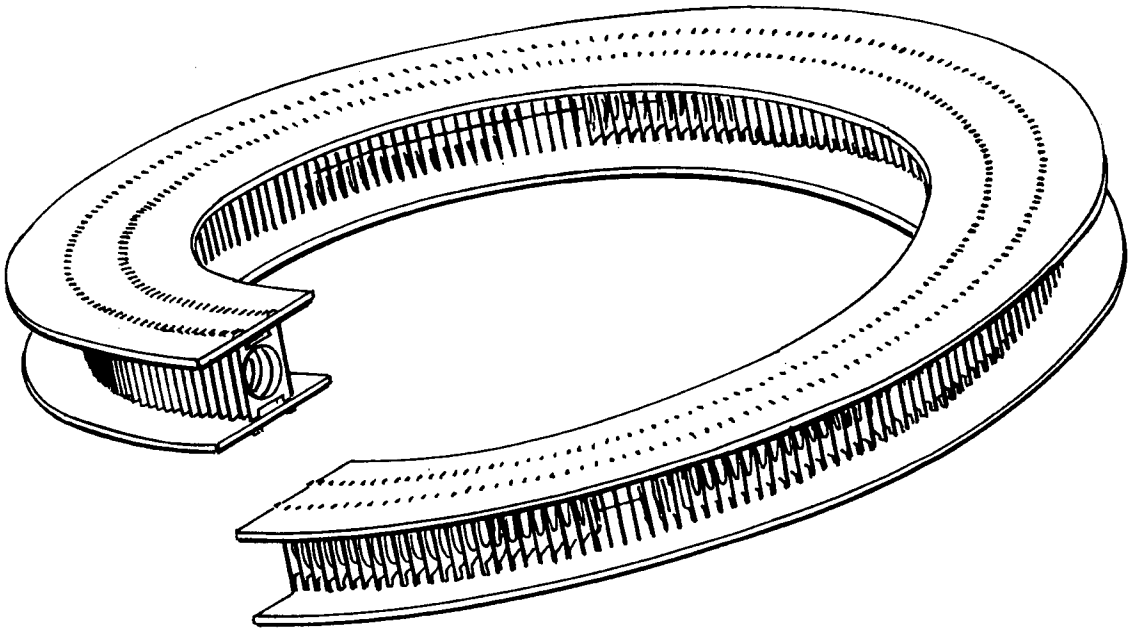
FIG. 7 shows another embodiment wherein a helical ion guide or ion mobility separator is formed by two circuit boards which are interlinked by a plurality of plate electrodes having apertures through which ions are transmitted in use.

FIG. 7 shows a second main embodiment wherein a helical ion guide or ion mobility separator is formed comprising two circuit boards wherein a plurality of plates or electrodes are preferably provided between the two circuit boards. The plates preferably have an aperture through which ions are preferably transmitted in use.

According to an embodiment a plurality of discrete plates are preferably provided and a different or discrete DC voltage or potential may preferably be applied to each plate. According to an embodiment a potential divider may be provided in order to apply appropriate DC voltages to the plurality of plates. According to a particularly preferred embodiment adjacent plates may be connected to opposite phases of an AC or RF voltage supply in a similar manner to a conventional ion tunnel ion guide arrangement in order to confine ions radially within the helical ion guide or helical ion mobility spectrometer.

Figure 8:
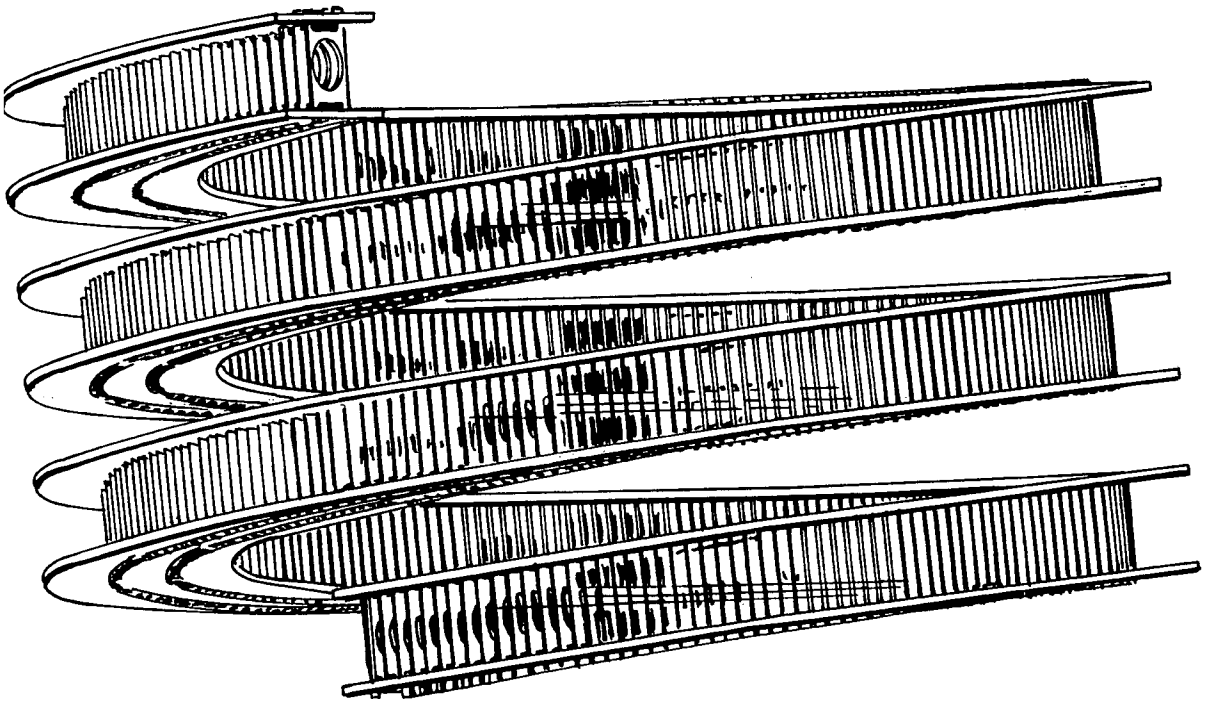
FIG. 8 shows a helical ion guide or ion mobility separator according to an embodiment wherein the ion guide or ion mobility separator comprises a plurality of turns on the helix so that an ion guide or ion mobility separator having a relatively long drift path is provided.

FIG. 8 shows an embodiment wherein an helical ion guide or ion mobility separator is provided comprising a number of turns on the helix. According to this embodiment an ion guide or ion mobility separator is provided which has a relatively long drift path.

Figure 9:
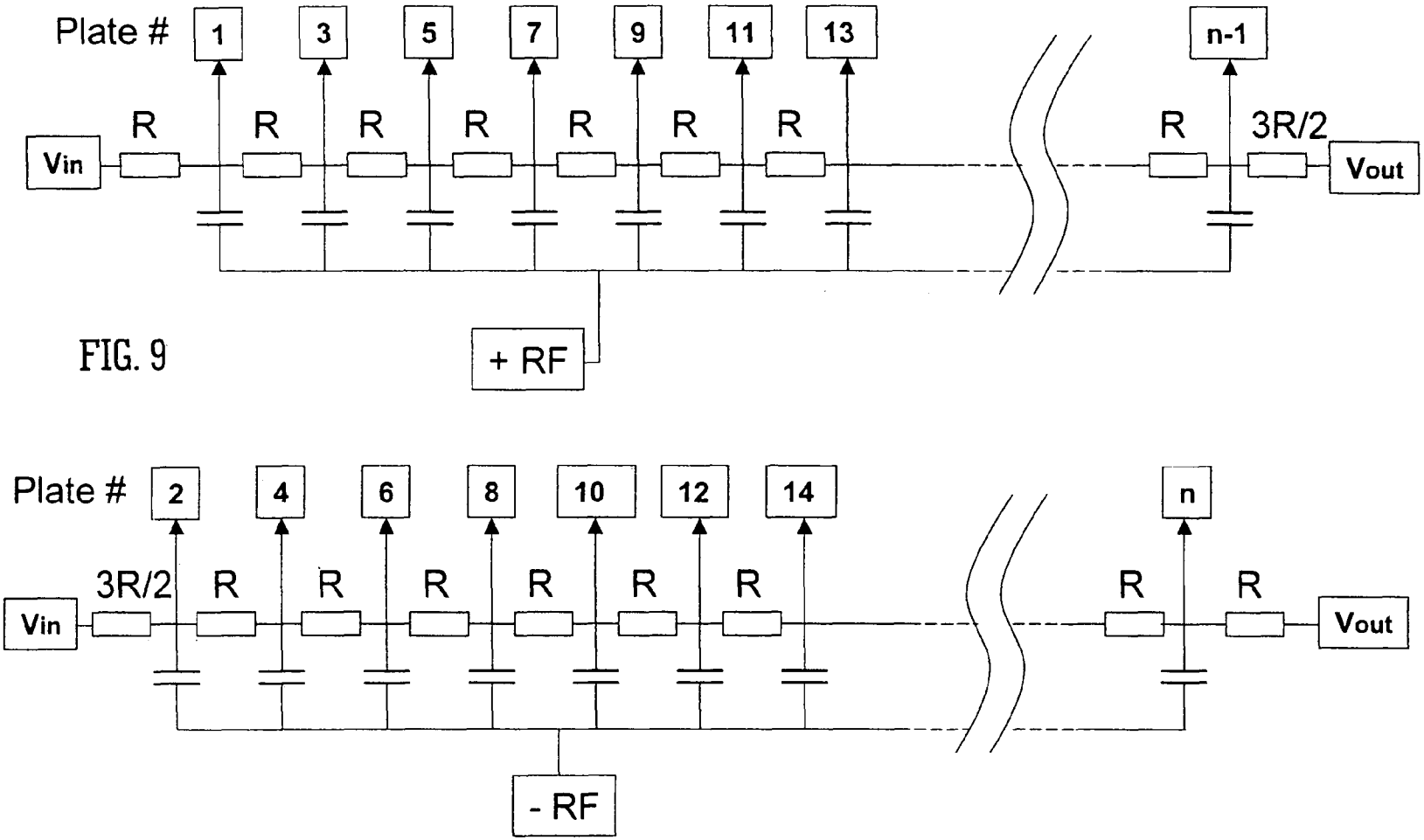
FIG. 9 shows a divider network which may be used to supply both DC and RF voltages to a helical ion guide or ion mobility spectrometer according to an embodiment of the present invention.

FIG. 9 shows a divider network according to an embodiment which may be used to supply appropriate DC and AC/RF voltages to a plurality of n separate plates or electrodes which preferably form the preferred ion guide or ion mobility separator. An AC or RF voltage is preferably supplied to the plates or electrodes via the capacitors. A DC voltage is preferably supplied to the plates or electrodes via the resistor network. A 3R/2 value resistor is preferably located at the beginning of the chain of even numbered plates or electrodes and a 3R/2 value resistor is preferably located at the end of the chain of odd numbered plates or electrodes. This arrangement preferably ensures that a continuous driving field is preferably provided along and around the length of the whole ion guide or ion mobility spectrometer or separator.

Figure 10:
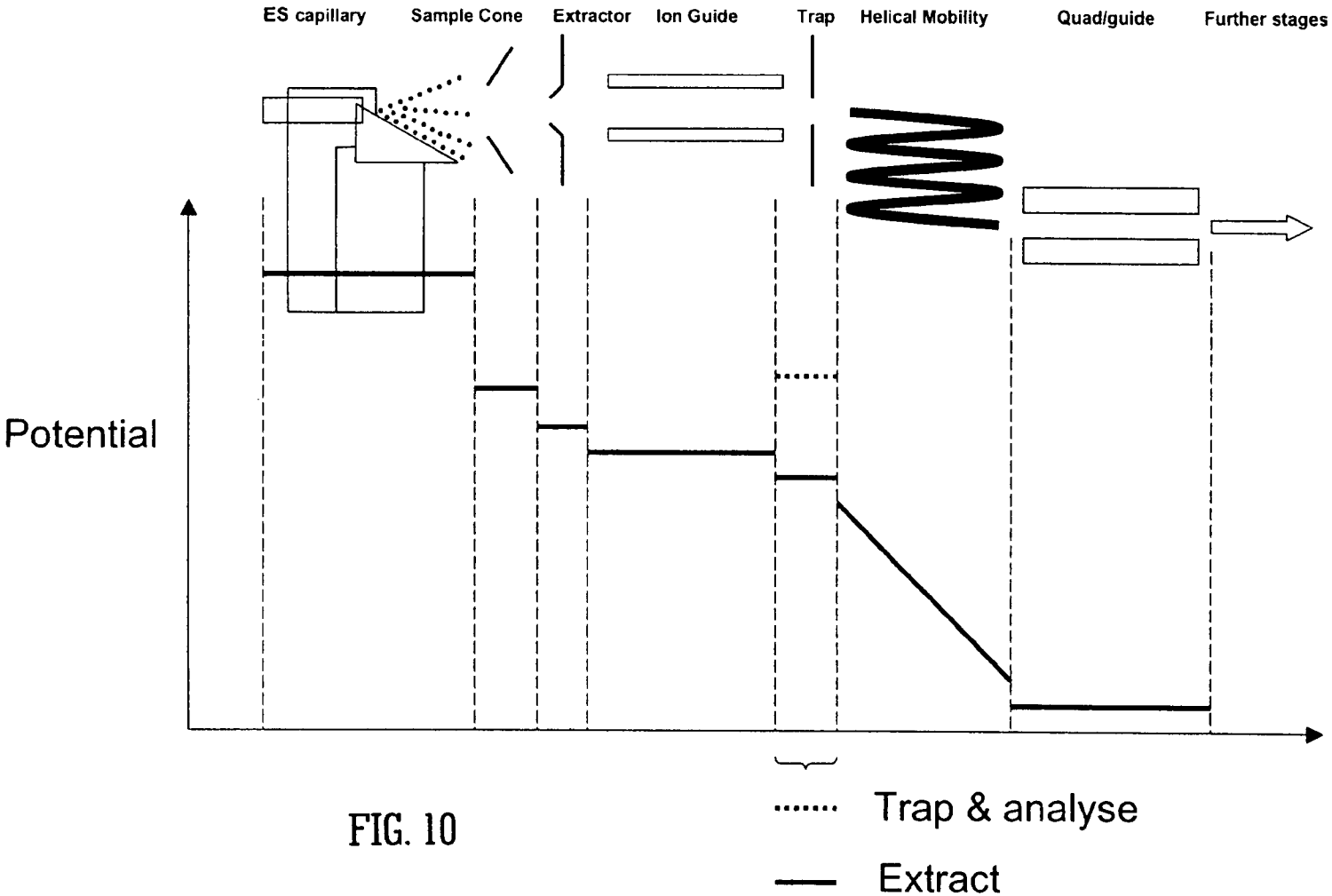
FIG. 10 shows an embodiment wherein a helical ion mobility spectrometer is provided as a stage of a mass spectrometer and a static voltage drop is maintained across the ion mobility spectrometer.

FIG. 10 shows an embodiment wherein a helical ion mobility spectrometer or separator is incorporated into an Electrospray mass spectrometer. According to this embodiment ions are preferably trapped in an ion guide arranged upstream of the helical mobility spectrometer or separator by raising the potential of a trap electrode which is preferably arranged downstream of the ion guide. The potential of the trap electrode may be momentarily reduced so that ions are preferably pulsed in, for example, a 100 μs pulse into or towards a preferred helical ion mobility spectrometer or separator which is preferably arranged downstream of the ion guide and trap electrode. The ions preferably pass into the helical mobility ion mobility separator and the potential of the trap electrode is then preferably raised.

A second or subsequent group of ions is then preferably trapped within the ion guide and the first group of ions which has already been pulsed into the helical ion mobility spectrometer or separator is preferably separated according to their ion mobility as they pass or transit through the helical mobility ion guide. The transit time of ions through the preferred helical ion mobility spectrometer or separator is preferably in the range 10-100 ms. Ions exiting the helical ion mobility spectrometer or separator are then preferably transmitted to a quadrupole ion guide or other component of a mass spectrometer. A slight disadvantage of the embodiment shown in FIG. 10 is that a relatively large potential difference (e.g. 1 kV) may need to be maintained across the length of the helical ion mobility spectrometer or separator. As a result, the potential of the ion source is also preferably maintained at a relatively high level.

Figure 11:
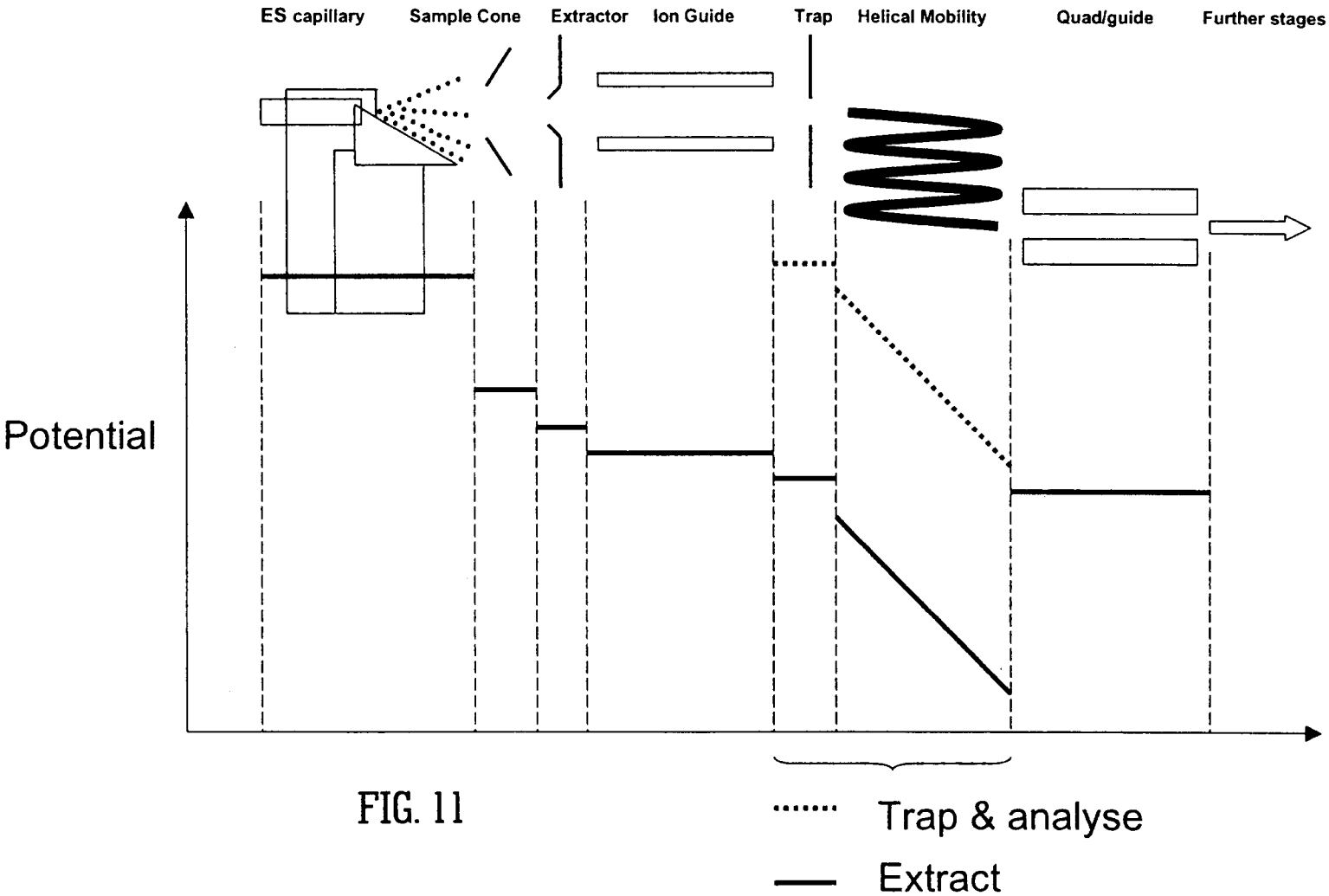
FIG. 11 shows an embodiment wherein a helical ion mobility spectrometer is provided as a stage of a mass spectrometer and a dynamic voltage lift is maintained across the ion mobility spectrometer.

FIG. 11 shows another embodiment of the present invention wherein the voltage drop across the helical ion mobility spectrometer or separator is initially pulsed low in order to allow at least some ions to enter the helical ion mobility spectrometer or separator when ions are pulsed out from the ion guide. Once ions have entered the helical ion mobility spectrometer or separator the potential of the trap electrode is then preferably raised to a relatively high potential. The potential of the helical ion mobility spectrometer or separator is then also preferably lifted or raised. As a result, a quadrupole rod set, ion guide or other component of a mass spectrometer arranged downstream of the helical ion mobility spectrometer or separator may be maintained at a potential which is preferably closer to the potential at which the ion source is maintained than in the embodiment described above with reference to FIG. 10. Ions which emerge from the helical ion mobility spectrometer or separator preferably pass to a downstream stage which may according to an embodiment comprise a quadrupole rod set or ion guide. The advantage of this particular embodiment is that no tracking of voltages is required downstream or upstream of the helical ion mobility spectrometer or separator. Furthermore, the overall voltage drop across the mass spectrometer from the ion source to, for example, the pusher electrode of an orthogonal acceleration Time of Flight mass analyser arranged downstream of the helical ion mobility spectrometer or separator and other components may advantageously be reduced.

Although the present invention has been described with reference to preferred embodiments, it will be understood by those skilled in the art that various changes in form and detail may be made without departing from the scope of the invention as set forth in the accompanying claims.

The invention claimed is:

1. An ion guide comprising:

one or more helical tubes through which ions are transmitted in use each tube having a length;

one or more RF, helically-shaped electrodes arranged on or in either an outer or inner surface of said one or more tubes and extending along at least a portion of the respective length of each tube; and a device arranged and adapted to supply, in use, an RF voltage to said one or more RF electrodes.

2. An ion guide as claimed in claim 1, wherein said one or more tubes are formed from a leaky dielectric, resistive glass, lead silicate doped glass or a ceramic.

3. An ion guide as claimed in claim 1, wherein either:

(a) said RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; or (b) said RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz;(xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

4. An ion guide as claimed in claim 1, further comprising either:

(a) one or more resistive, semiconductive or conductive surfaces or coatings arranged on or in an inner surface of said one or more tubes and extending along the length for more than one helical turn; or (b) one or more resistive, semiconductive or conductive surfaces or coatings arranged on or in an outer surface of said one or more tubes and extending along the length for more than one helical turn.

5. An ion guide as claimed in claim 4, wherein either:

(a) said ion guide further comprises a device arranged and adapted to supply one or more DC voltages to said one or more resistive, semiconductive or conductive surfaces or coatings; or (b) said ion guide comprises a device arranged and adapted to maintain a DC voltage or potential gradient along at least 5%, 10%, 15%, 20%, 25%, 30%, 35%, 40%, 45%, 50%, 55%, 60%, 65%, 70%, 75%, 80%, 85%, 90%, 95% or 100% of the length of said ion guide; or (c) said ion guide comprises an ion entrance port and an ion exit port and wherein, in use, a non-zero DC voltage gradient is maintained between said ion entrance port or an entrance region of said ion guide and said ion exit port or an exit region of said ion guide, wherein said non-zero DC voltage gradient is arranged to urge, force, drive or propel ions through said ion guide from said ion entrance port to said ion exit port.

6. The ion guide as claimed in claim 1, further comprising a device arranged and adapted to maintain a DC potential gradient to cause the transmitted ions to separate according to their ion mobility.

7. The ion guide as claimed in claim 1, further comprising:

one or more resistive, semiconductive or conductive surfaces or coatings arranged on or in the inner surface of said one or more tubes each tube extending for more than two helical turns and each one or more resistive, semiconductive or conductive surfaces or coatings extending along the length of each tube for more than one of the helical turns;

a device arranged and adapted to supply one or more DC voltages to said one or more resistive, semiconductive or conductive surfaces or coatings; and a device arranged and adapted to maintain a DC potential gradient to cause the transmitted ions to separate according to their ion mobility wherein the one or more RF electrodes are arranged on or in the outer surface of said one or more tubes.

8. An ion guide comprising:

a first helical board;

a second helical board;

a plurality of electrodes connecting the first and second boards each electrode having one or more apertures through which ions are transmitted in use, wherein said ion guide comprises a helical ion guiding region; and a device arranged and adapted to supply, in use, an RF voltage to said plurality of electrodes.

9. An ion guide as claimed in claim 8, wherein either:

(a) said RF voltage has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; or (b) said RF voltage has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

10. An ion guide as claimed in claim 8, wherein either:

(a) said ion guide further comprises a device arranged and adapted to supply one or more DC voltages to said plurality of electrodes; or (b) said ion guide comprises a device arranged and adapted to maintain a DC voltage gradient along at least 5%, 10%, 15%, 20%, 25%, 30%, 35%, 40%, 45%, 50%, 55%, 60%, 65%, 70%, 75%, 80%, 85%, 90%, 95% or 100% of the length of said ion guide; or (c) said ion guide comprises an ion entrance port and an ion exit port and wherein, in use, a non-zero DC voltage gradient is maintained between said ion entrance port or an entrance region of said ion guide and said ion exit port or an exit region of said ion guide, wherein said non-zero DC voltage gradient is arranged to urge, force, drive or propel ions through said ion guide from said ion entrance port to said ion exit port.

11. An ion guide as claimed in claim 8, wherein said ion guide further comprises transient DC voltage means arranged and adapted to apply one or more transient DC voltages or one or more transient DC voltage waveforms to at least some of said plurality of electrodes in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of said ion guide.

12. An ion guide as claimed in claim 11, further comprising means arranged and adapted to vary, increase or decrease the amplitude or velocity of said one or more transient DC voltages or said one or more transient DC voltage waveforms with time or wherein the amplitude or velocity of said one or more transient DC voltages or said one or more transient DC voltage waveforms is ramped, stepped, scanned or varied linearly or non-linearly with time.

13. An ion guide as claimed in claim 8, further comprising one or more first substrates provided on a first side of said plurality of electrodes or one or more second substrates provided on a second side of said plurality of electrodes.

14. An ion guide as claimed in claim 13, wherein said one or more first substrates or said one or more second substrates are formed from a material selected from the group consisting of: (i) a circuit board; (ii) a printed circuit board; (iii) a non-conductive substrate; (iv) phenolic paper; (v) glass fibre; (vi) plastic; (vii) polyimide;

(viii) Teflon; (ix) ceramic; (x) laminate; (xi) FR-2; (xii) FR-4; (xiii) GETEK; (xiv) BT-Epoxy; (xv) cyanate ester; (xvi) pyralux; and (xvii) Polytetrafluoroethylene "PTFE").

15. An ion guide as claimed in claim 8, wherein an entrance region or a central region or an exit region of said ion guide is maintained in use at a pressure selected from the group consisting of: (i) >100 mbar; (ii) >10 mbar; (iii) >1 mbar; (iv) >0.1 mbar; (v) $>10^{-2}$ mbar; (vi) $>10^{-3}$ mbar; (vii) $>10^{-4}$ mbar; (viii) $>10^{-5}$ mbar; (ix) $>10^{-6}$ mbar; (x) <100 mbar; (xi) <10 mbar; (xii) <1 mbar; (xiii) <0.1 mbar; (xiv) $<10^{-2}$ mbar; (xv) $<10^{-3}$ mbar; (xvi) $<10^{-4}$ mbar; (xvii) $<10^{-5}$ mbar; (xviii) $<10^{-6}$ mbar; (xix) 10-100 mbar; (xx) 1-10 mbar; (xxi) 0.1-1 mbar; (xxii) $10^{-2}$ to $10^{-1}$ mbar; (xxiii) $10^{-3}$ to $10^{-2}$ mbar; (xxiv) $10^{-4}$ to $10^{3}$ mbar; and (xxv) $10^{-5}$ to $10^{-4}$ mbar.

16. An ion guide as claimed in claim 8, further comprising RF voltage means arranged and adapted to apply two or more phase-shifted AC or RF voltages to electrodes forming at least part of said ion guide in order to urge, force, drive or propel at least some ions along at least 5%, 10%, 15%, 20%, 25%, 30%, 35%, 40%, 45%, 50%, 55%, 60%, 65%, 70%, 75%, 80%, 85%, 90%, 95% or 100% of the length of said ion guide.

17. The ion guide as claimed in claim 8, further comprising a device arranged and adapted to supply one or more DC voltages to the plurality of electrodes to cause the transmitted ions to separate according to their ion mobility.

18. The ion guide as claimed in claim 8, further comprising:

one or more first substrates provided on a first side of said plurality of electrodes or one or more second substrates provided on a second side of said plurality of electrodes; and a device arranged and adapted to supply one or more DC voltages to the plurality of electrodes to cause the transmitted ions to separate according to their ion mobility.

19. A method of ion mobility separation conducted with an ion guide including one or more helical tubes through which ions are transmitted in use each tube having a length and one or more helically-shaped RF electrodes arranged on or in either an outer or inner surface of said one or more tubes and extending along at least a portion of the respective length of each tube, said method comprising:

supplying an RF voltage to said one or more RF electrodes; and transmitting ions through the ion guide.

20. The method of ion mobility separation as claimed in claim 19 wherein the ion guide further includes one or more resistive, semiconductive or conductive surfaces or coatings arranged on or in an inner surface of said one or more tubes each tube extending for more than two helical turns and each one or more resistive, semiconductive or conductive surfaces or coatings extending along the length of each tube for more than one of the helical turns and the one or more RF electrodes are arranged on or in the outer surface of said one or more tubes, said method further comprising:

supplying one or more DC voltages to said one or more resistive, semiconductive or conductive surfaces or coatings; and maintaining a DC potential gradient to cause the transmitted ions to separate according to their ion mobility.

* * * * *

UNITED STATES PATENT AND TRADEMARK OFFICE

CERTIFICATE OF CORRECTION

PATENT NO. : 8,552,366 B2
APPLICATION NO. : 12/528454
DATED : October 8, 2013
INVENTOR(S) : Hoyes It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 961 days.

Signed and Sealed this
Tenth Day of March, 2015

Michelle K. Lee

Michelle K. Lee
*Deputy Director of the United States Patent and Trademark Office*